US008781134B2

(12) United States Patent
Moon et al.

(10) Patent No.: US 8,781,134 B2
(45) Date of Patent: Jul. 15, 2014

(54) METHOD AND APPARATUS FOR ENCODING AND DECODING STEREO AUDIO

(75) Inventors: Han-gil Moon, Seoul (KR); Chul-woo Lee, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 385 days.

(21) Appl. No.: 12/868,248

(22) Filed: Aug. 25, 2010

(65) Prior Publication Data

US 2011/0051935 A1 Mar. 3, 2011

(30) Foreign Application Priority Data

Aug. 27, 2009 (KR) ..... 10-2009-0079773

(51) Int. Cl.
*H04R 5/00* (2006.01)

(52) U.S. Cl.
USPC ..... 381/22; 381/23; 704/500; 704/501; 704/200; 704/E19.001; 704/E19.005

(58) Field of Classification Search
CPC ..... G10L 19/00; H04R 5/00
USPC ..... 381/1, 17, 22–23; 704/500–501, 200, 704/203, 201, E19.001, E19.005
See application file for complete search history.

(56) References Cited

U.S. PATENT DOCUMENTS

| | | | | |
|---|---|---|---|---|
| 7,765,104 | B2 * | 7/2010 | Pang et al. | 704/500 |
| 7,797,163 | B2 * | 9/2010 | Pang et al. | 704/500 |
| 7,965,848 | B2 * | 6/2011 | Villemoes et al. | 381/22 |
| 8,111,829 | B2 * | 2/2012 | Choo et al. | 381/10 |
| 8,254,584 | B2 * | 8/2012 | Kim et al. | 381/2 |
| 2008/0253576 | A1 * | 10/2008 | Choo et al. | 381/10 |
| 2009/0003611 | A1 * | 1/2009 | Oh et al. | 381/17 |
| 2009/0210236 | A1 * | 8/2009 | Moon et al. | 704/500 |
| 2011/0046964 | A1 * | 2/2011 | Moon et al. | 704/500 |
| 2011/0051939 | A1 * | 3/2011 | Moon et al. | 381/22 |

* cited by examiner

*Primary Examiner* — Disler Paul
(74) *Attorney, Agent, or Firm* — Sughrue Mion, PLLC

(57) ABSTRACT

A method of encoding stereo audio that minimizes a number of pieces of side information required for parametric-encoding and parametric-decoding of the stereo audio. The side information may include parameters about interchannel intensity difference (IID), interchannel correlation (IC), overall phase difference (OPD), and interchannel phase difference (IPD), which are required to restore the mono audio to the stereo audio.

29 Claims, 9 Drawing Sheets

METHOD AND APPARATUS FOR ENCODING AND DECODING STEREO AUDIO

CROSS-REFERENCE TO RELATED PATENT APPLICATION

This application claims priority from Korean Patent Application No. 10-2009-0079773, filed on Aug. 27, 2009, in the Korean Intellectual Property Office, the disclosure of which is incorporated herein by reference in its entirety.

BACKGROUND OF THE INVENTION

1. Field of the Invention

The present invention relates to a method and apparatus for encoding and decoding stereo audio, and more particularly, to a method and apparatus for parametric-encoding and parametric-decoding stereo audio by minimizing the number of pieces of side information required for parametric-encoding and parametric-decoding the stereo audio.

2. Description of the Related Art

Generally, methods of encoding multi-channel (MC) audio include waveform audio coding and parametric audio coding. Examples of the waveform audio coding include moving picture experts group (MPEG)-2 MC audio coding, advanced audio coding (AAC) MC audio coding, and bit sliced arithmetic coding (BSAC)/audio video coding standard (AVS) MC audio coding.

In the parametric audio coding, an audio signal is encoded by analyzing a component of the audio signal, such as a frequency or amplitude, and parameterizing information about the component. When stereo audio is encoded by using the parametric audio coding, mono audio is generated by down-mixing right channel audio and left channel audio, and then the generated mono audio is encoded. Then, parameters about interchannel intensity difference (IID), interchannel correlation (IC), overall phase difference (OPD), and interchannel phase difference (IPD), which are required to restore the mono audio to the stereo audio, are encoded. Here, the parameters may also be called side information.

The parameters about IID and IC are encoded as information for determining the intensities of the left channel audio and the right channel audio, and the parameters about OPD and IPD are encoded as information for determining the phases of the left channel audio and the right channel audio.

SUMMARY OF THE INVENTION

The present invention provides a method and apparatus for parametric-encoding and parametric-decoding stereo audio by minimizing the number of pieces of side information required for performing parametric-encoding and parametric-decoding the stereo audio.

According to an aspect of the present invention, there is provided a method of encoding audio, the method including: generating a first beginning divided audio signal and a second beginning divided audio signal from a beginning mono audio signal, the beginning mono audio signal generated from first and second center input audio signals located in the center of received N input audio signals; generating a first final divided audio signal and a second final divided audio signal by adding remaining input audio signals, among the N input audio signals other than the first and second center input audio signals, to each of the first and second beginning divided audio signals, and generating a final mono audio signal by adding the first and second final divided audio signals; generating side information for restoring each of the N input audio signals, the first and second beginning divided audio signals, the first and second final divided audio signals, and transient divided audio signals, the transient divided audio signals generated from the remaining input audio signals; and encoding the final mono audio signal and the side information.

The method may further include: encoding the N input audio signals; decoding the encoded N input audio signals; and generating information about differences between the decoded N input audio signals and the received N input audio signals, wherein, in the encoding of the final mono audio signal and the side information, the information about the differences is encoded.

The encoding of the side information may include: encoding information for determining intensities of the first and second center input audio signals, the remaining input audio signals, the first and second beginning divided audio signals, the transient divided audio signals, and the first and second final divided audio signals; and encoding information about phase differences between the first and second center input audio signals in the first and second center input audio signals, the remaining input audio signals, the first and second beginning divided audio signals, the transient divided audio signals, and the first and second final divided audio signals.

The encoding of the information for determining intensities may include: generating a vector space in which a first vector and a second vector form a predetermined angle, wherein the first vector represents an intensity the first center input audio signal, and the second vector represents an intensity of the second center input audio signal; generating a third vector by adding the first vector and the second vector in the vector space; and encoding at least one of information about an angle between the third vector and the first vector, and information about an angle between the third vector and the second vector, in the vector space.

The encoding of the information for determining intensities may comprise encoding at least one of information for determining an intensity of the first beginning divided audio signal and information for determining an intensity of the second beginning divided audio signal.

According to another aspect of the present invention, there is provided a method of decoding audio, the method including: extracting an encoded mono audio signal and encoded side information from received audio data; decoding the extracted mono audio signal and the extracted side information; restoring first and second beginning restored audio signals from the decoded mono audio signal, and generating N−2 final restored audio signals from transient restored audio signals by decoding the first and second beginning restored audio signals, based on the decoded side information; and generating a combination restored audio signal by adding the transient restored audio signals that are generated last from among the transient restored audio signals, and generating first and second final restored audio signals from the combination restored audio signal based on the decoded side information.

The method may further include extracting information about differences between N decoded audio signals and N original audio signals in the received audio data, wherein the N decoded audio signals may be generated by encoding and decoding the N original audio signals, wherein the first and second final restored audio signals may be generated based on the decoded side information and the information about the differences.

The decoded side information may include: information for determining intensities of the first and second beginning restored audio signals, the transient restored audio signals, and the first and second final restored audio signals; and information about phase differences between the first and second final restored audio signals restored from the first and second beginning restored audio signals, the transient restored audio signals, and first and second the final restored audio signals.

The method of claim 8, wherein the information for determining the intensities comprises information about an angle between a first vector and a third vector or between a second vector and the third vector in a vector space generated in such a way that the first vector and the second vector form a predetermined angle, wherein the first vector is about intensity of one of two following restored audio signals of each of the beginning restored audio signals, the transient restored audio signals, and the final restored audio signals, the second vector is about intensity of the other of the two following restored audio signals, and the third vector is generated by adding the first and second vectors.

The restoring of the first and second beginning restored audio signals may include: determining an intensity of at least one of the first beginning restored audio signal and the second beginning restored audio signal, by using at least one of the angle between the first vector and the third vector and the angle between the second vector and the third vector; calculating a phase of the first beginning restored audio signal and a phase of the second beginning restored audio signal based on information about a phase of the decoded mono audio signal and information about a phase difference between the first beginning restored audio signal and the second beginning restored audio signal; and restoring the first and second beginning restored audio signals based on the information about the phase of the decoded mono audio signal, the information about the phase of the second beginning restored audio signal, and the information for determining the intensities of the first and second beginning restored audio signals.

When a first final transient restored audio signal from among the final transient restored audio signals and the first final restored audio signal are restored from a $J-1^{th}$ transient restored audio signal, and the second final restored audio signal and a second final transient restored audio signal having an intensity that is the same as an intensity and a phase that is the same phase as the first final transient restored audio signal is restored from a $J^{th}$ transient restored audio signal, the second final restored audio signal may be restored by subtracting the first final transient restored audio signal from the $J^{th}$ transient restored audio signal, when the first final transient restored audio signal is restored based on information about a phase of the $J-1^{th}$ transient restored audio signal, the information about a phase difference between the first final restored audio signal and the first final transient restored audio signal, and information for determining the intensity of the first final transient restored audio signal.

According to another aspect of the present invention, there is provided an apparatus for encoding audio, the apparatus including: a mono audio generator that generates a first beginning divided audio signal and a second beginning divided audio signal from a beginning mono audio signal, the beginning mono audio signal generated from first and second center input audio signals located in the center of received N input audio signals, generates a first final divided audio signal and a second final divided audio signal by adding remaining input audio signals, among the N input audio signals other than the first and second center input audio signals, to each of the first and second beginning divided audio signals, and generates a final mono audio signal by adding the first and second final divided audio signals; a side information generator that generates side information for restoring each of the N input audio signals, the first and second beginning divided audio signals, the first and second final divided audio signals, and transient divided audio signals, the transient divided audio signals generated from the remaining input audio signals; and an encoder that encodes the final mono audio signal and the side information.

The mono audio generator may include a plurality of down-mixers that each add two of audio signals among the N input audio signals, the first and second beginning divided audio signals, the transient mono audio signals, and the first and second final divided audio signals.

The apparatus may further include a difference information generator that encodes the N input audio signals, decodes the encoded N input audio signals, and generates information about differences between the N decoded input audio signals and the N received input audio signals, wherein the encoder may encode the information about the differences with the final mono audio signal and the side information.

According to another aspect of the present invention, there is provided an apparatus for decoding audio, the apparatus including: an extractor that extracts an encoded mono audio signal and encoded side information from received audio data; a decoder that decodes the extracted mono audio signal and the extracted side information; an audio restorer that restores first and second beginning restored audio signals from the decoded mono audio signal, generates N−2 final restored audio signals from transient restored audio signals by decoding the first and second beginning restored audio signals, generates, based on the decoded side information, a combination restored audio signal by adding the transient restored audio signals that are generated last from among the transient restored audio signals, and generates first and second final restored audio signals from the combination restored audio signal based on the decoded side information.

The audio restorer may include a plurality of up-mixers that generate first and second restored audio signals from audio signals of each of the decoded mono audio signal, the beginning restored audio signals, and the transient restored audio signals, based on the side information.

According to another aspect of the present invention, there is provided a computer readable recording medium having recorded thereon a program for executing a method of encoding audio, the method including: generating a first beginning divided audio signal and a second beginning divided audio signal from a beginning mono audio signal, the beginning mono audio signal generated from first and second center input audio signals located in the center of received N input audio signals; generating a first final divided audio signal and a second final divided audio signal by adding remaining input audio signals, among the N input audio signals other than the first and second center input audio signals, to each of the first and second beginning divided audio signals, and generating a final mono audio signal by adding the first and second final divided audio signals; generating side information for restoring each of the N input audio signals, the first and second beginning divided audio signals, the first and second final divided audio signals, and transient divided audio signals, the transient divided audio signals generated from the remaining input audio signals; and encoding the final mono audio signal and the side information.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF THE INVENTION

Hereinafter, the present invention will be described more fully with reference to the accompanying drawings, in which exemplary embodiments of the invention are shown.

Figure 1:
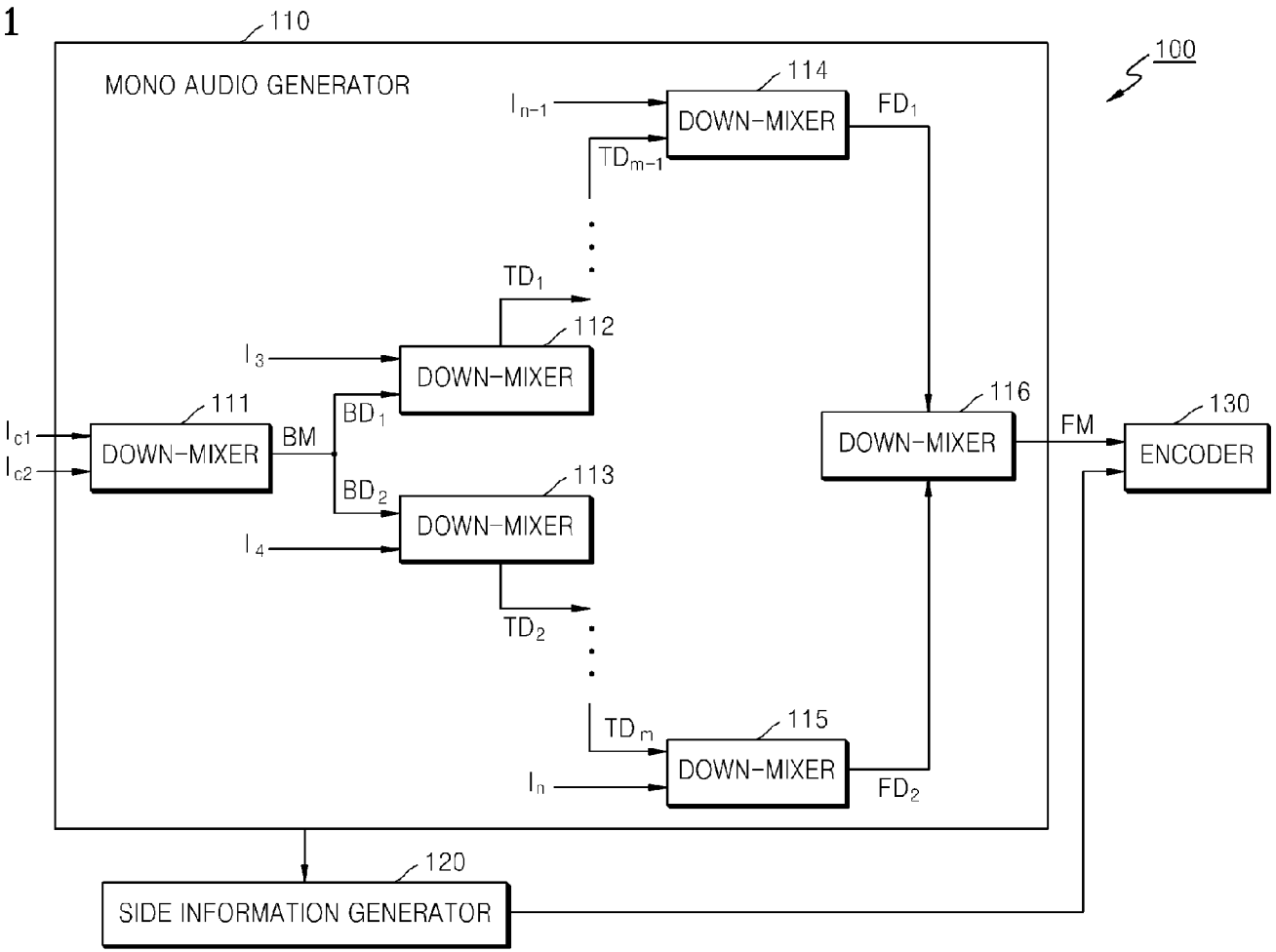
FIG. 1 is a diagram illustrating an apparatus for encoding audio, according to an exemplary embodiment of the present invention.

FIG. 1 is a diagram illustrating an apparatus for encoding audio, according to an exemplary embodiment of the present invention.

Referring to FIG. 1, the apparatus 100 includes a mono audio generator 110, a side information generator 120, and an encoder 130.

The mono audio generator 110 generates a first beginning divided audio signal $BD_1$ and a second beginning divided audio signal $BD_2$ from a beginning mono audio signal BM, which is generated by adding a first center input audio signal $I_{c1}$ and a second center input audio signal $I_{c2}$ that are located in the center of N received input audio signals $I_{c1}$, $I_{c2}$, and $I_3$ through $I_n$, wherein N and n are positive integers. The mono audio generator 110 also generates a first final divided audio signal $FD_1$ and a second final divided audio signal $FD_2$ by adding the remaining input audio signals $I_3$ through $I_n$ to each of the first and second beginning divided audio signals $BD_1$ and $BD_2$ one by one in the order of adjacency to each of the first and second beginning divided audio signals $BD_1$ and $BD_2$. The mono audio generator 111 then generates a final mono audio signal FM by adding the first and second final divided audio signals $FD_1$ and $FD_2$.

Here, the mono audio generator 110 generates a first through $m^{th}$ transient divided audio signals $TD_1$ through $TD_m$ while generating the final mono audio signal FM from the first and second beginning divided audio signals $BD_1$ and $BD_2$, wherein m is a positive integer.

Also, as illustrated in FIG. 1, the mono audio generator 110 includes a plurality of down-mixers 111-116 that add audio signals received from a combination of each of the input audio signals $I_{c1}$, $I_{c2}$, and $I_c$ through $I_n$, the first and second beginning divided audio signals $BD_1$, $BD_2$, the first through $m^{th}$ transient divided audio signals $TD_1$ through $TD_m$, and the first and second final divided audio signals $FD_1$ and $FD_2$. The final mono audio signal FM is generated through the plurality of down-mixers.

For example, a down-mixer 111, which received the first and second center input audio signals $I_{c1}$ and $I_{c2}$, generates the beginning mono audio signal BM by adding the first and second center input audio signals $I_{c1}$ and $I_{c2}$. Here, the number of audio signals that are to be input to down-mixers 112, 113, which are downstream to down-mixer 111, is 3, i.e., an odd number (signals BM, $I_3$, and $I_4$). Thus, the down-mixer 111 that generated the beginning mono audio signal BM divides the beginning mono audio signal BM to generate the first beginning divided audio signal $BD_1$ and the second beginning divided audio signal $BD_2$. Accordingly, the number of audio signals that are to be input to down mixers 112 and 113 is four, and two audio signals are input to each of down-mixers 112, 113.

When the first and second beginning divided audio signals $BD_1$ and $BD_2$ are generated as described above, the down-mixer 112 that received the first beginning divided audio signal $BD_1$ generates the first transient divided audio signal $TD_1$ by adding the first beginning divided audio signal $BD_1$ and a third input audio signal $I_3$, i.e., an input audio signal that is most adjacent to the first center input audio signal $I_{c1}$ from among the remaining input audio signals $I_3$ through $I_n$, and the down-mixer 113 that received the second beginning divided audio signal $BD_2$ generates the second transient divided audio signal $TD_2$ by adding the second beginning divided audio signal $BD_2$ and a fourth input audio signal $I_4$, i.e., an input audio signal that is most adjacent to the second center input audio signal $I_{c2}$ from among the remaining input audio signals $I_3$ through $I_n$.

In other words, a down-mixer 112, 113 of the present invention receives an audio signal generated by a previous down-mixer 111 as one input, and receives one of the remaining input audio signals $I_3$ through $I_n$ as another input, and adds the two inputs.

Here, the down-mixers 111-116 may adjust a phase of one of two audio signals to be identical to a phase of the other of the two audio signals before adding the two audio signals, instead of adding the two audio signals as they are received. For example, before adding the first and second center input audio signals $I_{c1}$ and $I_{c2}$, a phase of the second center input audio signal $I_{c2}$ may be adjusted to be identical to a phase of the first center input audio signal $I_{c1}$, thereby adding the phase-adjusted second center input audio signal $I_{c2'}$ with the first center input audio signal $I_{c1}$. The details thereof will be described later.

Meanwhile, according to the current embodiment of the present invention, the N input audio signals $I_{c1}$, $I_{c2}$, and $I_3$ through $I_n$ transmitted to the mono audio generator 110 are considered to be digital signals, but when the N input audio signals $I_{c1}$, $I_{c2}$, and $I_3$ through $I_n$ are analog signals according to another embodiment of the present invention, the N analog input audio signals $I_{c1}$, $I_{c2}$, and $I_3$ through $I_n$ may be converted to digital signals before being input to the mono audio generator 110, by performing sampling and quantization on the N input audio signals $I_{c1}$, $I_{c2}$, and $I_3$ through $I_n$.

The side information generator 120 generates side information required to restore each of the first and second center input audio signals $I_{c1}$ and $I_{c2}$, the remaining input audio signals $I_3$ through $I_n$ that are added one by one, the first and second beginning divided audio signals $BD_1$ and $BD_2$, the first through $m^{th}$ transient divided audio signals $TD_1$ through $TD_m$, and the first and second final divided audio signals $FD_1$ and $FD_2$.

Here, whenever the down-mixers 111-116 included in the mono audio generator 110 add audio signals, the side information generator 120 generates side information required to restore the added audio signals based on the result of adding the audio signals. Here, for convenience of description, the side information input from each down-mixer to the side information generator 120 is not illustrated in FIG. 1.

Here, the side information includes information for determining intensities of each of the first and second center input audio signals $I_{c1}$ and $I_{c2}$, the remaining input audio signals $I_3$ through $I_n$ that are added one by one, the first and second beginning divided audio signals $BD_1$ and $BD_2$, the first through $m^{th}$ transient divided audio signals $TD_1$ through $TD_m$, and the first and second final divided audio signals $FD_1$ and $FD_2$, and information about phase differences between the two added audio signals of the first and second center input audio signals $I_{c1}$ and $I_{c2}$, the remaining input audio signals $I_3$ through $I_n$ that are added one by one, the first and second beginning divided audio signals $BD_1$ and $BD_2$, the first through $m^{th}$ transient divided audio signals $TD_1$ through $TD_m$, and the first and second final divided audio signals $FD_1$ and $FD_2$.

According to another embodiment of the present invention, each down-mixer 111-116 may include the side information generator 120 in order to add the audio signals while generating the side information about the audio signals.

A method of generating the side information, wherein the method is performed by the side information generator 120, will be described in detail later with reference to FIGS. 2 through 4.

The encoder 130 encodes the final mono audio signal FM generated by the mono audio generator 110 and the side information generated by the side information generator 120.

Here, a method of encoding the final mono audio signal FM and the side information may be any general method used to encode mono audio and side information.

According to another exemplary embodiment of the present invention, the apparatus 100 may further include a difference information generator (not shown) which encodes the N input audio signals $I_{c1}$, $I_{c2}$, and $I_3$ through $I_n$, decodes the N encoded input audio signals $I_{c1}$, $I_{c2}$, and $I_3$ through $I_n$, and then generates information about differences between the N decoded input audio signals $I_{c1}$, $I_{c2}$, and $I_3$ through $I_n$ and the N original input audio signals $I_{c1}$, $I_{c2}$, and $I_3$ through $I_n$.

As such, when the apparatus 100 includes the difference information generator, the encoder 130 may encode the information about differences along with the final mono audio signal FM and the side information. When the encoded mono audio signal generated by the apparatus 100 is decoded, the information about differences is added to the decoded mono audio signal, so that audio signals similar to the original N input audio signals $I_{c1}$, $I_{c2}$, and $I_3$ through $I_n$ are generated.

According to another exemplary embodiment of the present invention, the apparatus 100 may further include a multiplexer (not shown), which generates a final bitstream by multiplexing the final mono audio signal FM and the side information that are encoded by the encoder 130.

A method of generating side information and a method of encoding the generated side information will now be described in detail. For convenience of description, the side information generated while the down-mixers 111-116 included in the mono audio generator 110 generate the beginning mono audio signal BM by receiving the first and second center input audio signals $I_{c1}$ and $I_{c2}$ will be described. Also, a case of generating information for determining intensities of the first and second center input audio signals $I_{c1}$ and $I_{c2}$, and a case of generating information for determining phases of the first and second center input audio signals $I_{c1}$ and $I_{c2}$ will be described.

(1) Information for Determining Intensity

According to parametric audio coding, each channel audio signal is changed to a frequency domain, and information about the intensity and phase of each channel audio signal is encoded in the frequency domain, as will be described in detail with reference to FIG. 2.

Figure 2:
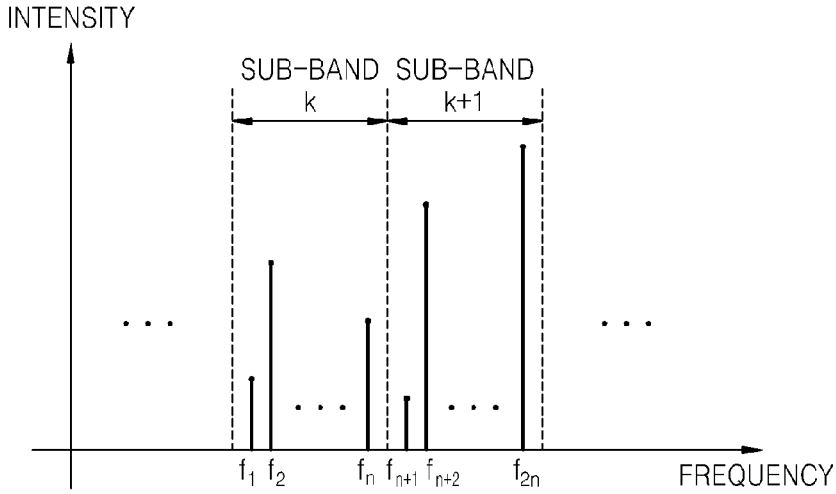
FIG. 2 is a diagram illustrating sub-bands in parametric audio coding.

FIG. 2 is a diagram illustrating sub-bands in parametric audio coding.

In detail, FIG. 2 illustrates a frequency spectrum in which an audio signal is converted to the frequency domain. When a fast Fourier transform is performed on the audio signal, the audio signal is expressed with discrete values in the frequency domain. In other words, the audio signal may be expressed as a sum of a plurality of sine curves.

In the parametric audio coding, when the audio signal is converted to the frequency domain, the frequency domain is divided into a plurality of sub-bands. Information for determining intensities of the first and second center input audio signals $I_{c1}$ and $I_{c2}$ and information for determining phases of the first and second center input audio signals $I_{c1}$ and $I_{c2}$ are encoded in each sub-band. Here, side information about intensity and phase in a sub-band k is encoded, and then side information about intensity and phase in a sub-band k+1 is encoded. As such, the entire frequency band is divided into sub-bands, and the side information is encoded according to each sub-band.

An example of encoding side information of the first and second center input audio signals $I_{c1}$ and $I_{c2}$ in a predetermined frequency band, i.e., in the sub-band k, will now be described in relation to encoding and decoding of stereo audio having input audio signals from N channels.

When side information about stereo audio is encoded according to conventional parametric audio coding, information about interchannel intensity difference (IID) and information about interchannel correlation (IC) is encoded as information for determining intensities of the first and second center input audio signals $I_{c1}$ and $I_{c2}$ in the sub-band k, as described above.

Here, in the sub-band k, the intensity of the first center input audio signal $I_{c1}$ and the intensity of the second center input audio signal $I_{c2}$ is calculated. A ratio of the intensity of the first center input audio signal $I_{c1}$ to the intensity of the second center input audio signal $I_{c2}$ is encoded as the information about IID. However, the ratio alone is not sufficient to determine the intensities of the first and second center input audio signals $I_{c1}$ and $I_{c2}$, and thus the information about IC is encoded as side information, along with the ratio, and inserted into a bitstream.

A method of encoding audio, according to an exemplary embodiment of the present invention, uses a vector representing the intensity of the first center input audio signal $I_{c1}$ in the sub-band k and a vector representing the intensity of the second center input audio signal $I_{c2}$ in the sub-band k, in order to minimize the number of pieces of side information encoded as the information for determining the intensities of the first and second center input audio signals $I_{c1}$ and $I_{c2}$ in the sub-band k. Here, an average value of intensities in frequencies $f_1$ through $f_n$ in the frequency spectrum, in which the first center input audio signal $I_{c1}$ is converted to the frequency domain, is the intensity of the first center input audio signal $I_{c1}$ in the sub-band k, and also is a size of a vector $I_{c1}$ that will be described later.

Similarly, an average value of intensities in frequencies $f_1$ through $f_n$ in the frequency spectrum, in which the second center input audio signal $I_{c2}$ is converted to the frequency domain, is the intensity of the second center input audio signal $I_{c2}$ in the sub-band k, and also is a size of a vector $I_{c2}$, as will be described in detail with reference to FIGS. 3A and 3B.

Figure 3A:
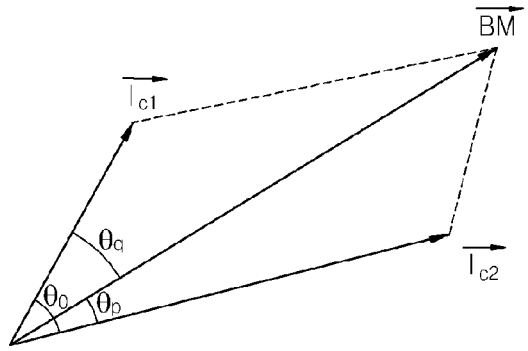
FIG. 3A is a diagram for describing a method of generating information about intensities of a first center input audio signal and a second center input audio signal, according to an exemplary embodiment of the present invention.

FIG. 3A is a diagram for describing a method of generating information about intensities of the first center input audio signal $I_{c1}$ and the second center input audio signal $I_{c2}$, according to an exemplary embodiment of the present invention.

Referring to FIG. 3A, the side information generator 120 generates a 2-dimensional (2D) vector space in such a way that the $I_{c1}$ vector, which is a vector about the intensity of the first center input audio signal $I_{c1}$ in the sub-band k, and the $I_{c2}$ vector, which is a vector about the intensity of the second center input audio signal $I_{c2}$ in the sub-band k, form a predetermined angle $\theta_0$. If the first and second center input audio signals $I_{c1}$ and $I_{c2}$ are respectively left audio and right audio, stereo audio is generally encoded assuming that a listener hears the stereo audio at a location where a left sound source direction and a right sound source direction form an angle of 60°. Accordingly, the predetermined angle $\theta_0$ between the $I_{c1}$ vector and the $I_{c2}$ vector in the 2D vector space may be 60°. However, according to the current exemplary embodiment of the present invention, since the first and second center input audio signals $I_{c1}$ and $I_{c2}$ are not respectively left audio and right audio, the $I_{c1}$ vector and the $I_{c2}$ vector may have a predetermined angle $\theta_0$.

In FIG. 3A, a BM vector, which is a vector about the intensity of the beginning mono audio signal BM and obtained by adding the $I_{c1}$ vector and the $I_{c2}$ vector, is illustrated. Here, as described above, if the first and second center input audio signals $I_{c1}$ and $I_{c2}$ respectively correspond to left audio and right audio, the listener, who listens to the stereo audio at the location where a left sound source direction and a right sound source direction form an angle of 60°, hears mono audio having an intensity corresponding to the size of the BM vector and in a direction of the BM vector.

The side information generator 120 generates information about an angle $\theta_q$ between the BM vector and the $I_{c1}$ vector or an angle $\theta_p$ between the BM vector and the $I_{c2}$ vector, instead of the information about IID and about IC, as the information for determining the intensities of the first and second center input audio signals $I_{c1}$ and $I_{c2}$ in the sub-band k.

Alternatively, instead of generating information about the angle $\theta_q$ or the angle $\theta_p$, the side information generator 120 may generate a cosine value, such as $\cos\theta_q$ or $\cos\theta_p$. This is because, a quantization process is performed when information about an angle is to be generated and encoded, and a cosine value of an angle is generated and encoded in order to minimize a loss occurring during the quantization process.

Figure 3B:
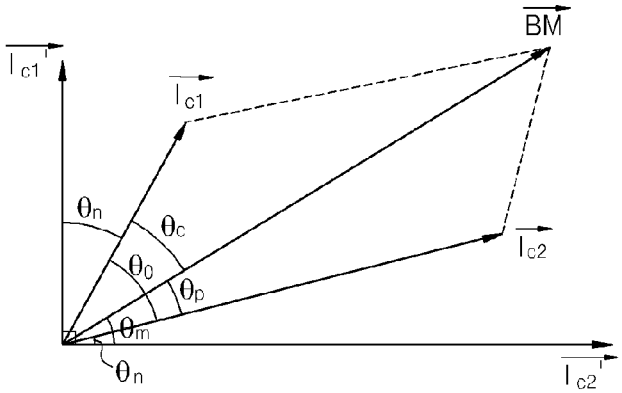
FIG. 3B is a diagram for describing a method of generating information about intensities of the first center input audio signal and the second center input audio signal, according to another exemplary embodiment of the present invention.

FIG. 3B is a diagram for describing a method of generating information about intensities of the first center input audio signal $I_{c1}$ and the second center input audio signal $I_{c2}$, according to another exemplary embodiment of the present invention.

In detail, FIG. 3B illustrates a process of normalizing a vector angle in FIG. 3A.

As shown in FIG. 3B, when the angle $\theta_0$ between the vector $I_{c1}$ and the vector $I_{c2}$ is not 90°, the angle $\theta_0$ may be normalized to 90°, and at this time, the angle $\theta_p$ or $\theta_q$ is also normalized. When the angle $\theta_0$ is normalized to 90°, the angle $\theta_p$ is normalized accordingly, and thus the angle $\theta_m=(\theta_p\times 90)/\theta_0$.

The side information generator 120 may generate an unnormalized angle $\theta_p$ or a normalized angle $\theta_m$ as the information for determining the intensities of the first and second center input audio signals $I_{c1}$ and $I_{c2}$. Alternatively, the side information generator 120 may generate $\cos\theta_p$ or $\cos\theta_m$, instead of the angle $\theta_p$ or $\theta_m$, as the information for determining the intensities of the first and second center input audio signals $I_{c1}$ and $I_{c2}$.

(2) Information for Determining Phase

In the conventional parametric audio coding, information about overall phase difference (OPD) and information about interchannel phase difference (IPD) is encoded as information for determining the phases of the first and second center input audio signals $I_{c1}$ and $I_{c2}$ in the sub-band k.

In other words, conventionally, the information about OPD is generated and encoded by calculating a phase difference between the first center input audio signal $I_{c1}$ in the sub-band k and the beginning mono audio signal BM generated by adding the first center input audio signal $I_{c1}$ and the second center input audio signal $I_{c2}$ in the sub-band k. The information about IPD is generated and encoded by calculating a phase difference between the first center input audio signal $I_{c1}$ and the second center input audio signal $I_{c2}$ in the sub-band k. The phase difference may be obtained by calculating each of the phase differences at the frequencies $f_1$ through $f_n$ included in the sub-band and calculating the average of the calculated phase differences.

However, the side information generator 120 only generates information about a phase difference between the first and second center input audio signals $I_{c1}$ and $I_{c2}$ in the sub-band k, as information for determining the phases of the first and second center input audio signals $I_{c1}$ and $I_{c2}$.

According to an exemplary embodiment of the present invention, the down-mixer 111-116 generates the phase-adjusted second center input audio signal $I_{c2'}$ by adjusting the phase of the second center input audio signal $I_{c2}$ to be identical to the phase of the first center input audio signal $I_{c1}$, and then adds the phase-adjusted second center input audio signal $I_{c2'}$ with the first center input audio signal $I_{c1}$. Thus, the phases of the first and second center input audio signals $I_{c1}$ and $I_{c2}$ are each calculated only based on the information about the phase difference between the first and second center input audio signals $I_{c1}$ and $I_{c2}$.

As an example of audio of the sub-band k, the phases of the second center input audio signal $I_{c2}$ in the frequencies $f_1$ through $f_n$ are each respectively adjusted to be identical to the phases of the first center input audio signal $I_{c1}$ in the frequencies $f_1$ through $f_n$. An example of adjusting the phase of the second center input audio signal $I_{c2}$ in the frequency $f_1$ will now be described. When the first center input audio signal $I_{c1}$ is expressed as $|I_{c1}|e^{i(2\pi f1t+\theta_1)}$ in the frequency $f_1$, and the second center input audio signal $I_{c2}$ is expressed as $|I_{c2}|e^{i(2\pi f1t+\theta_2)}$ in the frequency $f_1$, the phase-adjusted second center input audio signal $I_{c2'}$ in the frequency $f_1$ may be obtained as Equation 1 below. Here, $\theta_1$ denotes the phase of the first center input audio signal $I_{c1}$ in the frequency $f_1$ and $\theta_2$ denotes the phase of the second center input audio signal $I_{c2}$ in the frequency $f_1$.

$$I_{c2'}=I_{c2}\times e^{i(\theta_2-\theta_2)}=|I_{c2}|e^{i(2\pi f1t+\theta_1)} \quad \text{Equation 1}$$

According to Equation 1, the phase of the second center input audio signal $I_{c2}$ in the frequency $f_1$ is adjusted to be identical to the phase of the first center input audio signal $I_{c1}$. The phases of the second center input audio signal $I_{c2}$ are repeatedly adjusted in other frequencies $f_2$ through $f_n$ in the sub-band k, thereby generating the phase-adjusted second input audio signal $I_{c2'}$ in the sub-band k.

Since the phase of the phase-adjusted second center input audio signal $I_{c2'}$ is identical to the phase of the first center input audio signal $I_{c1}$ in the sub-band k, a decoding unit for the beginning mono audio signal BM can obtain the phase of the second center input audio signal $I_{c2}$ when only the phase difference between the first and second center input audio signals $I_{c1}$ and $I_{c2}$ is encoded. Since the phase of the first center input audio signal $I_{c1}$ and the phase of the beginning mono audio signal BM generated by the down-mixer are the same, information about the phase of the first center input audio signal $I_{c1}$ does not need to be separately encoded.

Accordingly, when only the information about the phase difference between the first and second center input audio signals $I_{c1}$ and $I_{c2}$ is encoded, the decoding unit can calculate the phases of the first and second center input audio signals $I_{c1}$ and $I_{c2}$ by using the encoded information.

Meanwhile, the method of encoding the information for determining the intensities of the first and second center input audio signals $I_{c1}$ and $I_{c2}$ by using intensity vectors of channel audio signals in the sub-band k, and the method of encoding the information for determining the phases of the first and second center input audio signals $I_{c1}$ and $I_{c2}$ in the sub-band k by adjusting the phases may be used independently or in combination. In other words, the information for determining the intensities of the first and second center input audio signals $I_{c1}$ and $I_{c2}$ is encoded by using a vector according to the present invention, and the information about OPD and IPD may be encoded as the information for determining the phases of the first and second center input audio signals $I_{c1}$ and $I_{c2}$ according to the conventional technology. Alternatively, the information about IID and IC may be encoded as the information for determining the intensities of the first and second center input audio signals $I_{c1}$ and $I_{c2}$ according to the conventional technology, and only the information for determining the phases of the first and second center input audio signals $I_{c1}$ and $I_{c2}$ may be encoded by using phase adjustment according to the present invention. Here, the side information may be encoded by using both methods according to the present invention.

Figure 4:
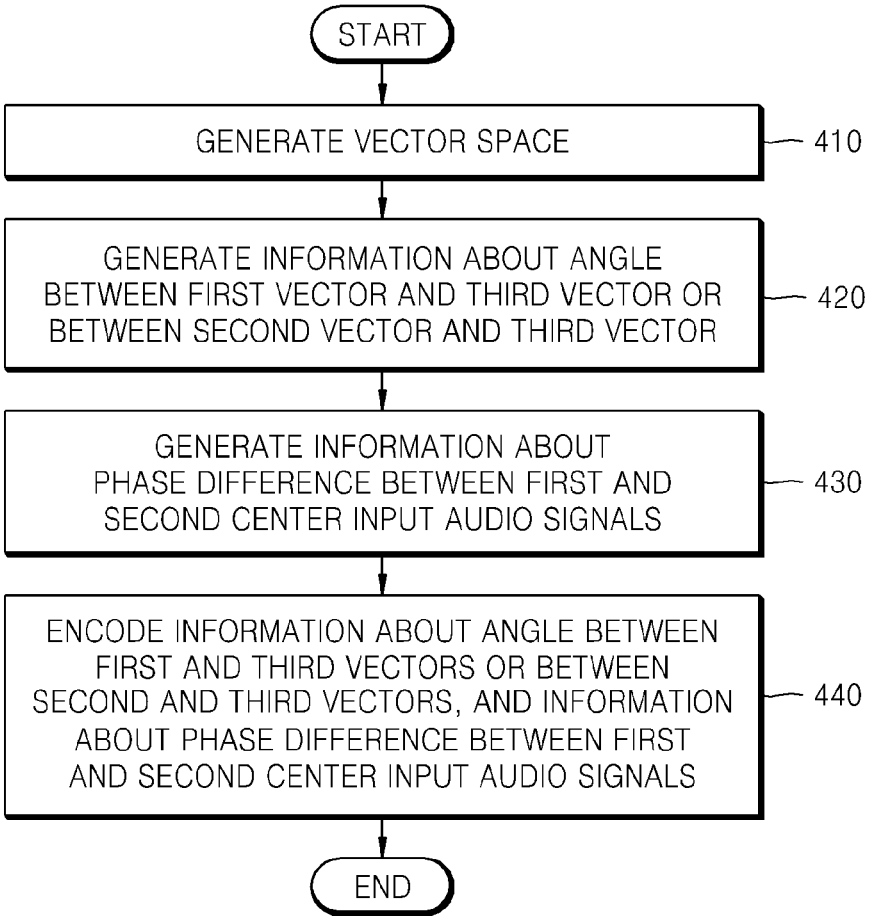
FIG. 4 is a flowchart illustrating a method of encoding side information, according to an exemplary embodiment of the present invention.

FIG. 4 is a flowchart illustrating a method of encoding side information, according to an exemplary embodiment of the present invention.

A method of encoding the information about the intensities and phases of the first and second center input audio signals $I_{c1}$ and $I_{c2}$ in a predetermined frequency band, i.e., in the sub-band k, will now be described with reference to FIG. 4.

In operation 410, the side information generator 120 generates a vector space in such a way that a first vector about the intensity of the first center input audio signal $I_{c1}$ in the sub-band k and a second vector about the intensity of the second center input audio signal $I_{c2}$ in the sub-band k form a predetermined angle.

Here, the side information generator 120 generates the vector space illustrated in FIG. 3A based on the intensities of the first and second center input audio signals $I^{c1}$ and $I_{c2}$ in the sub-band k.

In operation 420, the side information generator 120 generates information about an angle between the first vector and a third vector or between the second vector and the third vector, wherein the third vector represents the intensity of the beginning mono audio signal BM, which is generated by adding the first and second vectors in the vector space generated in operation 410.

Here, the information about the angle is the information for determining the intensities of the first and second center input audio signals $I_{c1}$ and $I_{c2}$ in the sub-band k. Also, the information about the angle may be information about a cosine value of the angle, instead of the angle itself.

Here, the beginning mono audio signal BM may be generated by adding the first and second center input audio signals $I_{c1}$ and $I_{c2}$, or by adding the first center input audio signal $I_{c1}$ and the phase-adjusted second center input audio signal $I_{c2'}$. Here, the phase of the phase-adjusted second center input audio signal $I_{c2'}$ is identical to the phase of the first center input audio signal $I_{c1}$ in the sub-band k.

In operation 430, the side information generator 120 generates the information about the phase difference between the first and second center input audio signals $I_{c1}$ and $I_{c2}$.

In operation 440, the encoder 130 encodes the information about the angle between the first and third vectors or between the second and third vectors, and the information about the phase difference between the first and second center input audio signals $I_{c1}$ and $I_{c2}$.

The method of generating and encoding side information described above with reference to FIGS. 2 through 4 may be identically applied to generate side information for restoring audio signals that are added in each of the N input audio signals $I_{c1}$, $I_{c2}$, and $I_c$ through $I_n$, the first and second beginning divided audio signals $BD_1$ and $BD_2$, the first through $m^{th}$ transient divided audio signals $TD_1$ through $TD_m$, and the first and second final divided audio signals $FD_1$ and $FD_2$ illustrated in FIG. 1.

Figure 5:
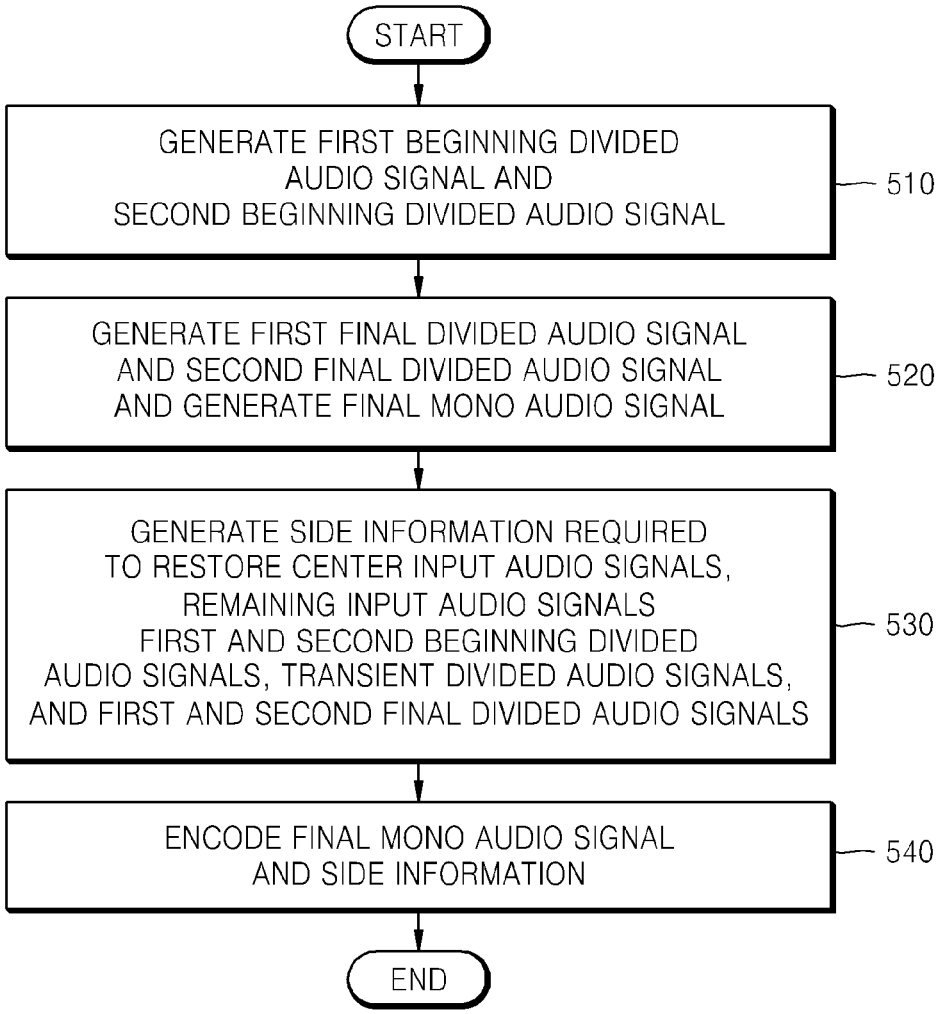
FIG. 5 is a flowchart illustrating a method of encoding audio, according to an exemplary embodiment of the present invention.

FIG. 5 is a flowchart illustrating a method of encoding audio, according to an exemplary embodiment of the present invention.

In operation 510, the first beginning divided audio signal $BD_1$ and the second beginning divided audio signal $BD_2$ are generated by dividing one beginning mono audio signal BM, which is generated by adding the first and second center input audio signals $I_{c1}$ and $I_{c2}$ that are located in the center from among the N received input audio signals $I_{c1}$, $I_{c2}$, and $I_3$ through $I_n$, where N and n are positive integers.

In operation 520, the first final divided audio signal $FD_1$ and the second final divided audio signal $FD_2$ are generated by adding the remaining input audio signals $I_3$ through $I_n$ to each of the first and second beginning divided audio signals $BD_1$ and $BD_2$ one by one in the order of adjacency to the each of the first and second beginning divided audio signals $BD_1$ and $BD_2$. The final mono audio signal FM is generated by adding the first and second final divided audio signals $FD_1$ and $FD_2$.

In operation 530, side information required to restore each of the first and second center input audio signals $I_{c1}$ and $I_{c2}$, the remaining input audio signals $I_3$ through $I_n$ that are added one by one, the first and second beginning divided audio signals $BD_1$ and $BD_2$, the first through $m^{th}$ transient divided audio signals $TD_1$ through $TD_m$, and the first and second final divided audio signals $FD_1$ and $FD_2$ is generated.

Here, the remaining input audio signals $I_3$ through $I_n$ are the N input audio signals $I_{c1}$, $I_{c2}$, and $I_3$ through $I_n$ excluding the first and second center input audio signals $I_{c1}$ and $I_{c2}$.

In operation 540, the final mono audio signal FM and the side information are encoded.

Figure 6:
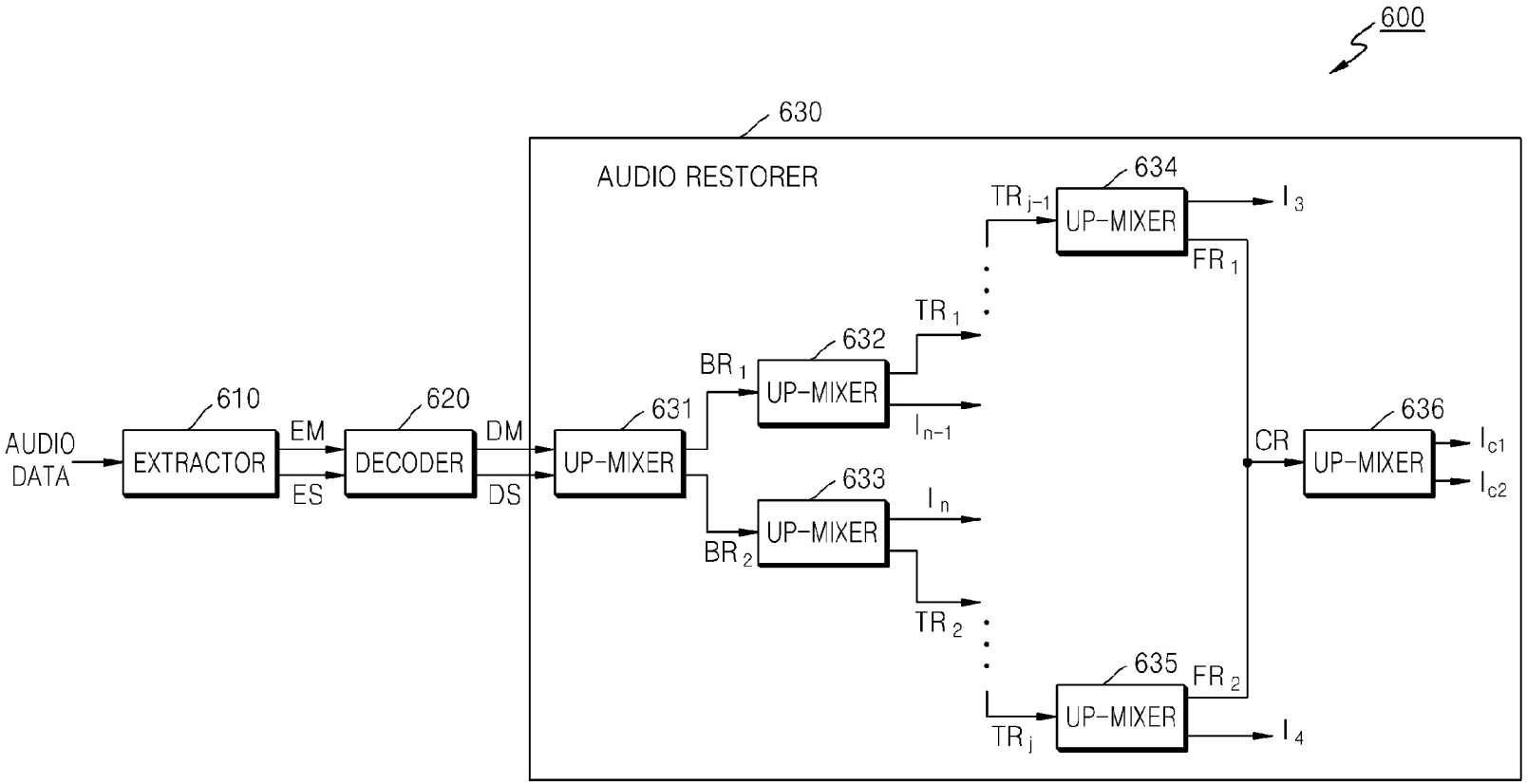
FIG. 6 is a diagram illustrating an apparatus for decoding audio, according to an exemplary embodiment of the present invention.

FIG. 6 is a diagram illustrating an apparatus for decoding audio, according to an exemplary embodiment of the present invention.

Referring to FIG. 6, the apparatus 600 includes an extractor 610, a decoder 620, and an audio restorer 630.

The extractor 610 extracts an encoded mono audio signal EM and encoded side information ES from received audio data. Here, the extractor 610 may also be called a demultiplexer.

According to another exemplary embodiment of the present invention, the encoded mono audio signal EM and the encoded side information ES may be received instead of the audio data, and in this case, the extractor 610 may not be included in the apparatus 600.

The decoder 620 decodes the encoded mono audio signal EM and the encoded side information ES extracted by the extractor 610 to produce decoded side information DS and a decoded mono audio signal DM, respectively.

The audio restorer 630 restores first and second beginning restored audio signals $BR_1$ and $BR_2$ from the decoded mono audio signal DM, generates N−2 final restored audio signals $I_3$ through $I_n$ by sequentially generating one final restored audio signal FR and one transient restored audio signal TR, by consecutively applying the same decoding method used to decode the extracted mono audio signal EM and the extracted side information ES, a plurality of times on each of the first and second beginning restored audio signals $BR_1$ and $BR_2$. The audio restorer 630 generates a combination restored audio signal CR by adding two final transient restored audio signals $FR_1$ and $FR_2$ that are generated last from among the generated transient restored audio signals $TR_1$ through $TR_j$, and then generates two final restored audio signals $I_{c1}$ and $I_{c2}$ additionally from the combination restored audio signal CR, based on the decoded side information DS, where j is a positive integer.

Also, as illustrated in FIG. 6, the audio restorer 630 includes a plurality of up-mixers 631-636, which generate restored audio signals from each one of the beginning restored audio signals $BR_1$ and $BR_2$, and the transient restored audio signals $TR_1$ through $TR_j$. The audio restorer 630 generates the final restored audio signals $I_{c1}$, $I_{c2}$, and $I_c$ through $I_n$ with the plurality of up-mixers 631-636.

In FIG. 6, the decoded side information DS is transmitted to the up-mixers 631-636 included in the audio restorer 630 through the decoder 620, but for convenience of description, the decoded side information DS transmitted to each of the up-mixers 631-636 is not illustrated.

Meanwhile, according to another exemplary embodiment of the present invention, if the extractor 610 further extracts information about differences between N decoded audio signals, which are generated by encoding and decoding N original audio signals that are to be restored from the audio data through the N final restored audio signals $I_{c1}$, $I_{c2}$, and $I_c$ through $I_n$, and the N original audio signals, the information about the differences is decoded by using the decoder 620. The decoded information about the differences may be added to each of the final restored audio signals $I_{c1}$, $I_{c2}$, and $I_c$ through $I_n$ generated by the audio restorer 630. Accordingly, the final restored audio signals $I_{c1}$, $I_{c2}$, and $I_c$ through $I_n$ are similar to the N original audio signals.

Operations of an up-mixer 636 will now be described in detail. Here, for convenience of description, the up-mixer 636 receives the combination restored audio signal CR and restores the first and second center input audio signals $I_{c1}$ and $I_{c2}$ as final restored audio signals.

Referring to the vector space illustrated in FIG. 3A, the up-mixer 636 uses information about an angle between a BM vector and a $I_{c1}$ vector or between the BM vector and a $I_{c2}$ vector as information for determining intensities of the first and second center input audio signals $I_{c1}$ and $I_{c2}$ in the sub-band k, wherein the BM vector represents the intensity of the combination restored audio signal CR, the vector $I_{c1}$ represents the intensity of the first center input audio signal $I_{c1}$, and the vector $I_{c2}$ represents the intensity of the second center input audio signal $I_{c2}$. The up-mixer 636 may use information about a cosine value of the angle between the BM vector and the $I_{c1}$ vector or between the BM vector and the $I_{c2}$ vector.

Referring to FIG. 3B, when an angle $\theta_0$ between the vector $I_{c1}$ and the vector $I_{c2}$ is 60°, the size of the intensity of the first center input audio signal $I_{c1}$, i.e., the size of the vector $I_{c1}$, may be calculated according to $|I_{c1}|=|BM|\times\sin\theta_m/\cos(\pi/12)$. Similarly, when an angle $\theta_0$ between the vector $I_{c1}$ and the vector $I_{c2}$ is 60°, the size of the intensity of the second center input audio signal $I_{c2}$, i.e., the size of the vector $I^{c2}$, may be calculated according to $|Ic2|=|BM|\times\cos\theta^m/\cos(\pi/12)$. Here, |BM| denotes the size of the intensity of the combination restored audio signal CR, i.e., the size of the BM vector, an angle between the vector $I_{c1}$ and a vector $I_{c1'}$ is 15°, and an angle between the vector $I_{c2}$ and a vector $I_{c2'}$ is 15°.

Also, the up-mixer 636 may use information about a phase difference between the first and second center input audio signals $I_{c1}$ and $I_{c2}$ as information for determining phases of the first and second center input audio signals $I_{c1}$ and $I_{c2}$ in the sub-band k. When the phase of the second center input audio signal $I_{c2}$ is already adjusted to be identical to the phase of the first center input audio signal $I_{c1}$ while encoding the combination restored audio signal CR, the up-mixer 636 may calculate the phases of the first and second center input audio signals $I_{c1}$ and $I_{c2}$ by using only the information about the phase difference between the first and second center input audio signals $I_{c1}$ and $I_{c2}$.

Meanwhile, the method of decoding the information for determining the intensities of the first and second center input audio signals $I_{c1}$ and $I_{c2}$ in the sub-band k by using a vector, and the method of decoding the information for determining the phases of the first and second center input audio signals $I_{c1}$ and $I_{c2}$ in the sub-band k by using phase adjustment as described above may be used independently or in combination.

Figure 7:
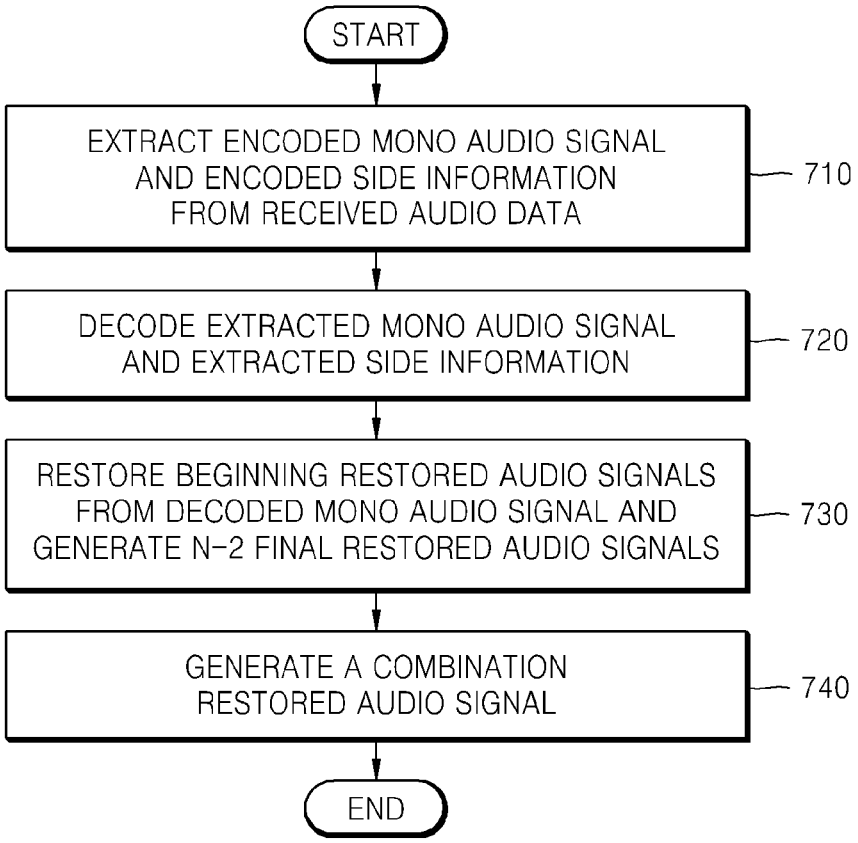
FIG. 7 is a flowchart illustrating a method of decoding audio, according to an exemplary embodiment of the present invention.

FIG. 7 is a flowchart illustrating a method of decoding audio, according to an exemplary embodiment of the present invention.

In operation 710, an encoded mono audio signal EM and encoded side information ES are extracted from received audio data.

In operation 720, the extracted mono audio signal EM and the extracted side information ES are decoded.

In operation 730, two beginning restored audio signals $BR_1$ and $BR_2$ are restored from the decoded mono audio signal DM based on the decoded side information DS, and N−2 final restored audio signals $I_3$ through $I_n$ are generated by sequentially generating one final restored audio signal and one transient restored audio signal by consecutively applying the same decoding method a plurality of times on each of the beginning restored audio signals $BR_1$ and $BR_2$.

In operation 740, a combination restored audio signal CR is generated by adding final transient restored audio signals $FR_1$ and $FR_2$ that are generated the last from among the generated transient restored audio signals $TR_1$ through $TR_j$, and then two final restored audio signals $I_{c1}$ and $I_{c2}$ are generated from the combination restored audio signal CR based on the decoded side information DS.

Figure 8:
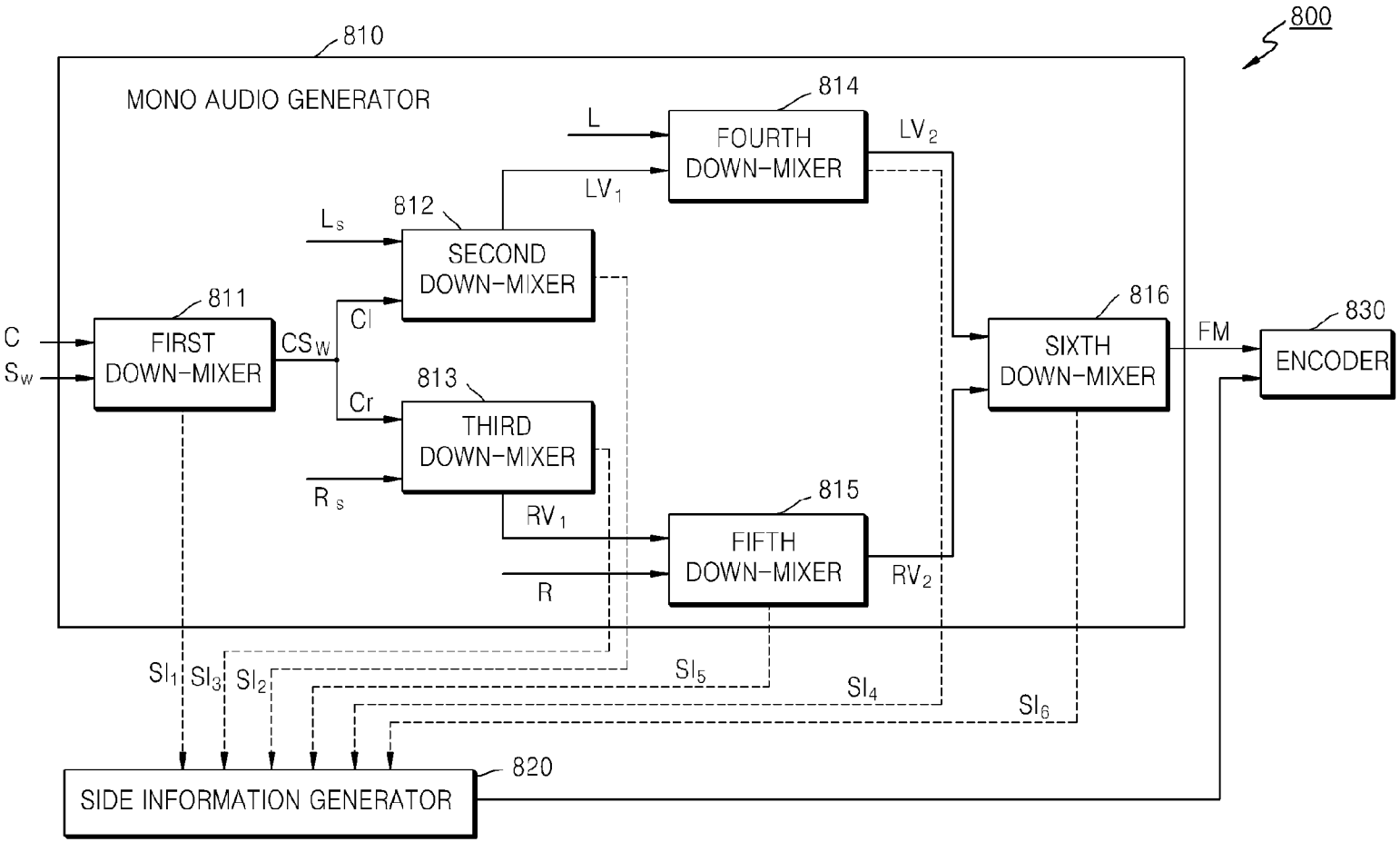
FIG. 8 is a diagram illustrating an apparatus for encoding 5.1-channel stereo audio, according to an exemplary embodiment of the present invention.

FIG. 8 is a diagram illustrating an apparatus for encoding 5.1-channel stereo audio, according to an exemplary embodiment of the present invention.

Referring to FIG. 8, the apparatus 800 includes a mono audio generator 810, a side information generator 820, and an encoder 830. Audio signals input to the apparatus 800 include a left channel front audio signal L, a left channel rear audio signal $L_s$, central audio signal C, a sub-woofer audio signal $S_w$, a right channel front audio signal R, and right channel rear audio signal $R_s$. Here, the central audio signal C and the sub-woofer audio signal $S_w$ respectively correspond to the first center input audio signal $I_{c1}$ and the second center input audio signal $I_{c2}$.

Operations of the mono audio generator 810 will now be described.

The mono audio generator 810 includes a plurality of down-mixers 811-816. A first down-mixer 811 generates a signal $CS_w$ by adding the central audio signal C and the sub-woofer audio signal $S_w$. Then, the first down-mixer 811 divides the signal $CS_w$ into signals Cl and Cr, which are respectively input to a second down-mixer 812 and a third down-mixer 813. Here, the signals Cl and Cr each have a size obtained by multiplying signal $CS_w$ by 0.5, but the sizes of the signals Cl and Cr are not limited thereto and any value may be used for the multiplication.

Here, first through sixth down-mixers 811 through 816 may adjust phases of two audio signals to be identical before adding the two audio signals.

The second down-mixer 812 generates signal $LV_1$ by adding the signal Cl and the left channel rear audio signal $L_s$, and the third down-mixer 813 generates signal $RV_1$ by adding the signal Cr and the right channel rear audio signal $R_s$.

The fourth down-mixer 814 generates signal $LV_2$ by adding the signal $LV_1$ and the left channel front audio signal L, and the fifth down-mixer 815 generates signal $RV_2$ by adding the signal $RV_1$ and the right channel front audio signal R.

The sixth down-mixer 816 generates a final mono audio FM by adding the signals $LV_2$ and $RV_2$.

Here, the signals Cl and Cr respectively correspond to the first and second beginning divided audio signals $BD_1$, $BD_2$, the signals $LV_1$ and the $RV_1$ respectively correspond to the transient divided audio signals $TD_1$ through TDj, the signals $LV_2$ and $RV_2$ respectively correspond to the first and second final divided audio signals $FD_1$ and $FD_2$, and the signals $L_s$, L, $R_s$, and R respectively correspond to the remaining input audio signals $I_3$ through $I_n$.

A side information generator 820 receives side information $SI_1$ through $SI_6$ from the first through sixth down-mixers 811 through 816, or reads the side information $SI_1$ through $SI_6$ from the first through sixth down-mixers 811 through 816 and outputs the side information $SI_1$ through $SI_6$ to the encoder 830. Here, dotted lines in FIG. 8 indicate that the side information $SI_1$ through $SI_6$ is transmitted from the first through sixth down-mixers 811 through 816 to the side information generator 820.

The encoder 830 encodes the final mono audio signal FM and the side information $SI_1$ through $SI_6$.

Figure 9:
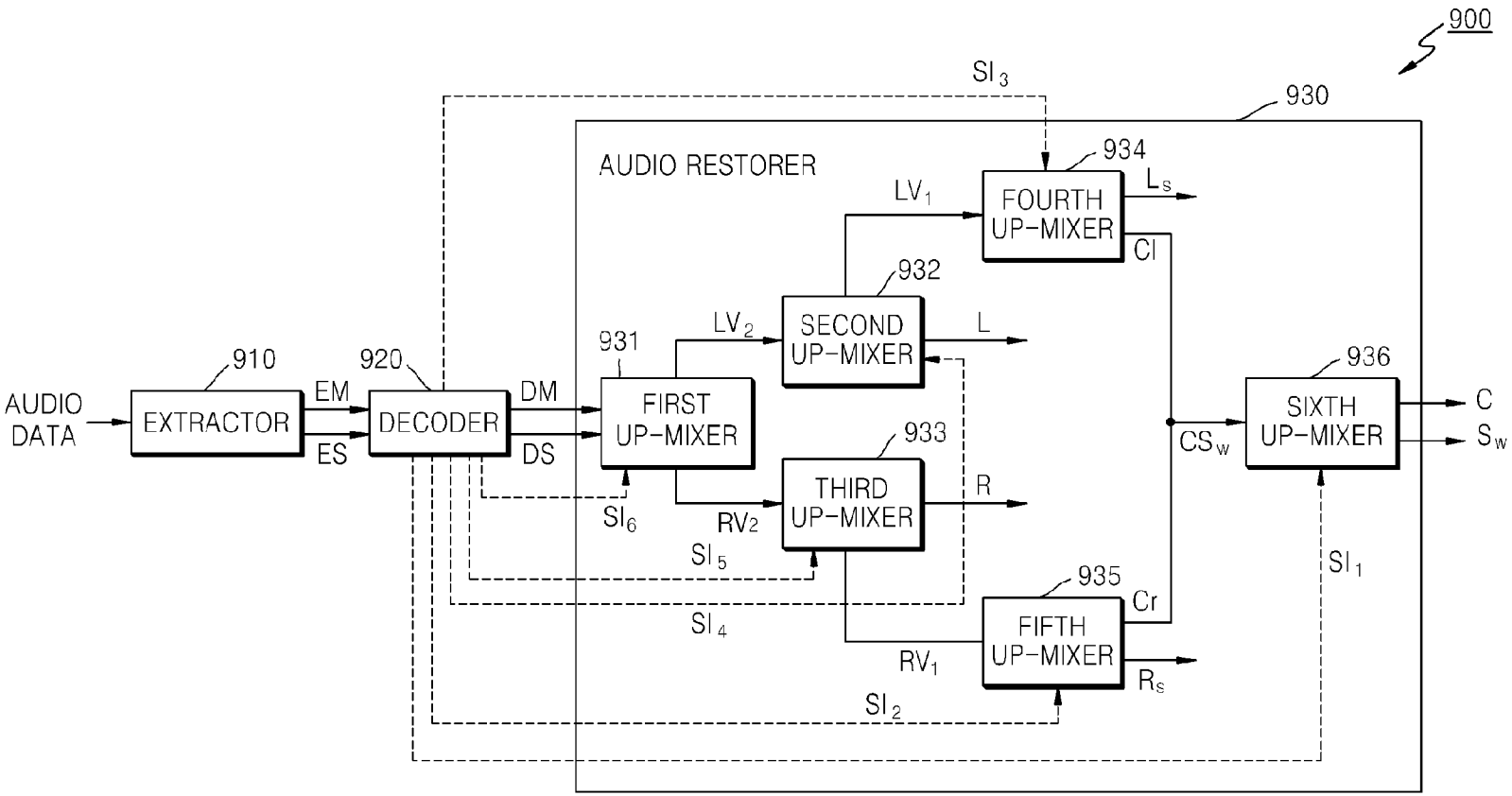
FIG. 9 is a diagram illustrating an apparatus for decoding 5.1-channel stereo audio, according to an exemplary embodiment of the present invention.

FIG. 9 is a diagram illustrating an apparatus for decoding 5.1-channel stereo audio, according to an exemplary embodiment of the present invention.

The apparatus 900 includes an extractor 910, a decoder 920, and an audio restorer 930. The operations of the extractor 910 and the decoder 920 of FIG. 9 are respectively similar to those of the extractor 610 and the decoder 620 of FIG. 6, and thus details thereof are omitted herein. The operations of the audio restorer 930 will now be described in detail.

The audio restorer 930 includes a plurality of up-mixers 931-936. A first up-mixer 931 restores signals $LV_2$ and $RV_2$ from a decoded mono audio signal DM.

Here, first through sixth up-mixers 931 through 936 perform restoration based on decoded side information $SI_1$ through $SI_6$ received from the decoder 920.

The second up-mixer 932 restores signals $LV_1$ and L from the signal $LV_2$, and the third up-mixer 933 restores signals $RV_1$ and R from the signal $RV_2$.

The fourth up-mixer 934 restores signals $L_s$ and Cl from the signal $LV_1$, and the fifth up-mixer 935 restores signals $R_s$ and Cr from signal $RV_1$.

The sixth up-mixer 936 generates signal $CS_w$ from signals Cl and Cr, and then restores C and $S_w$ from the signal $CS_w$.

Looking at the operations of the first through sixth up-mixers 931 through 936, the second through fifth up-mixers 932 through 935, excluding the first and sixth up-mixers 931 and 936, generate one transient restored audio signal and one final restored audio signal.

Here, the signals $LV_2$ and $RV_2$ respectively correspond to the first and second beginning restored audio signals $BR_1$ and $BR_2$, the signals $LV_1$ and $RV_1$ correspond to the transient restored audio signals TR, the signals Cl and CR respectively correspond to the final transient restored audio signals $FR_1$ and $FR_2$, and the signal $CS_w$ corresponds to the combination restored audio signal CR.

A method of restoring audio signals performed by the first through sixth up-mixers 931 through 936 will now be described in detail. Specifically, the operations of the fourth up-mixer 934 will be described with reference to FIG. 10.

Figure 10:
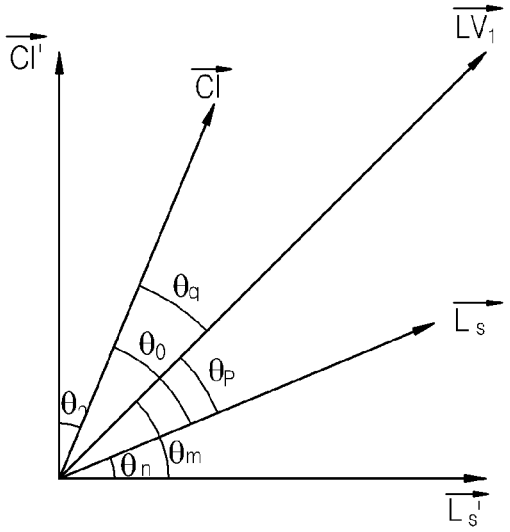
FIG. 10 is a diagram for describing an operation of an up-mixer, according to an exemplary embodiment of the present invention.

FIG. 10 is a diagram for describing the operations of the fourth up-mixer 934, according to an exemplary embodiment of the present invention.

Various methods of restoring the final transient restored audio signal Cl and the left channel rear audio signal $L_s$ will now be described.

A first method is to restore the final transient restored audio signal Cl and the left channel rear audio signal $L_s$ by using an angle $\theta_m$, obtained by normalizing an angle $\theta_p$ between the $LV_1$ vector and the $L_s$ vector as described above. Referring to FIG. 3B, when an angle $\theta_0$ is normalized to 90°, the angle $\theta_p$ is also normalized, and thus the angle $\theta_m=(\theta_p\times 90)/\theta_0$. As such, when the angle $\theta_m$ is calculated, the size of the vector Cl is calculated according to $|LV_1|\sin\theta_m/\cos\theta_n$ and the size of the vector $L_s$ is calculated according to $|LV_1|\cos\theta_m/\cos\theta_n$, thereby determining the intensities of the final transient restored audio signal Cl and the left channel rear audio signal $L_s$. Then, the phases of the final transient restored audio signal Cl and the left channel rear audio signal $L_s$ are calculated based on side information. Thus, the final transient restored audio signal Cl and the left channel rear audio signal $L_s$ are restored.

In a second method, when the final transient restored audio signal Cl or the left channel rear audio signal $L_s$ are restored according to the first method, the final transient restored audio signal Cl is restored by subtracting the left channel rear audio signal $L_s$ from the transient mono audio signal $LV_1$, and the left channel rear audio signal $L_s$ is restored by subtracting the final transient restored audio signal Cl from the transient mono audio signal $LV_1$.

A third method is to restore audio signals by combining audio signals restored according to the first method and audio signals restored according to the second method in a predetermined ratio.

In other words, when the final transient restored audio signal Cl and the left channel rear audio signal $L_s$ restored according to the first method are respectively referred to as $Cl_y$ and $L_{sy}$, and the final transient restored audio signal Cl and the left channel rear audio signal $L_s$ restored according to the second method are respectively referred to as $Cl_z$ and $L_{sz}$, the intensities of the final transient restored audio signal Cl and the left channel rear audio signal $L_s$ are respectively determined according to $|Cl|=a\times|Cl_y|+(1-a)\times|Cl_z|$ and $|L_s|=a\times|L_{sy}|+(1-a)\times|L_{sz}|$. The phases of the final transient restored audio signal Cl and the left channel rear audio signal $L_s$ are calculated based on side information, thereby restoring the final transient restored audio signal Cl and the left channel rear audio signal $L_s$. Here, "a" is a value between 0 and 1.

According to another exemplary embodiment of the present invention, when the final restored audio signal Cl is restored by the fourth up-mixer 934 according to the above methods, the signal $R_s$ output from the fifth up-mixer 935 may be restored without using separate side information. In other words, the final restored audio signal Cl and $C_r$ are audio signals divided from the signal $CS_w$, and thus the intensities and the phases of the final restored audio signal Cl and $C_r$ are the same. Accordingly, the fifth up-mixer 935 may restore the vector $R_s$ by subtracting the vector Cl from the vector $RV_1$.

When such a method is applied to FIG. 6, and an up-mixer restores the final transient restored audio signals FR from a $j-1^{th}$ transient restored audio $TR_{j-1}$, a vector $I_4$ may be restored by subtracting a $j^{th}$ transient restored audio $TR_j$ from the restored final transient restored audio signal $FR_1$.

The embodiments of the present invention may be written as computer programs and can be implemented in general-use digital computers that execute the programs using a computer readable recording medium. Examples of the computer readable recording medium may include magnetic storage media (e.g., ROM, floppy disks, hard disks, etc.), optical recording media (e.g., CD-ROMs, or DVDs), and storage media.

While this invention has been particularly shown and described with reference to preferred embodiments thereof, it will be understood by those of ordinary skill in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A method of encoding audio, the method comprising:

adjusting a phase of a first center input audio signal located in a center of received N input audio signals to be corresponding to a phase of a second center input audio signal located in the center of the received N input audio signals;

generating a mono audio signal by using the phase-adjusted first center input audio signal and the second center input audio signal;

generating side information for restoring the first center input audio signal and the second center input audio signal; and encoding the mono audio signal and the side information, wherein the side information comprises a phase difference between the first center input audio signal and the second center input audio signal.

2. The method of claim 1, wherein the generating the mono audio signal comprises generating a first beginning divided audio signal and a second beginning divided audio signal from a beginning mono audio signal, the beginning mono audio signal generated from the phase-adjusted first center input audio signal and the second center input audio signal and generating a first final divided audio signal and a second final divided audio signal by using remaining input audio signals, among the N input audio signals other than the first and second center input audio signals, and each of the first and second beginning divided audio signals, and generating a final mono audio signal by adding the first and second final divided audio signals, and wherein the generating side information comprises generating side information for restoring each of the N input audio signals, the first and second beginning divided audio signals, and the first and second final divided audio signals.

3. The method of claim 2, further comprising:

encoding the N input audio signals;

decoding the encoded N input audio signals; and generating information about differences between the decoded N input audio signals and the received N input audio signals, wherein, in the encoding of the final mono audio signal and the side information, the information about the differences is encoded.

4. The method of claim 2, wherein the encoding of the side information comprises:

encoding information for determining intensities of the first and second center input audio signals, the remaining input audio signals, the first and second beginning divided audio signals, transient divided audio signals which are generated from the remaining input audio signals and the first and second beginning divided audio signals, and the first and second final divided audio signals; and encoding information about phase differences between the first and second center input audio signals in the first and second center input audio signals, the remaining input audio signals, the first and second beginning divided audio signals, the transient divided audio signals, and the first and second final divided audio signals.

5. The method of claim 4, wherein the encoding of the information for determining intensities comprises:

generating a vector space in which a first vector and a second vector form a predetermined angle, wherein the first vector represents an intensity of the first center input audio signal, and the second vector represents an intensity of the second center input audio signal;

generating a third vector by adding the first vector and the second vector in the vector space; and encoding at least one of information about an angle between the third vector and the first vector, and information about an angle between the third vector and the second vector, in the vector space.

6. The method of claim 4, wherein the encoding of the information for determining intensities comprises encoding at least one of information for determining an intensity of the first beginning divided audio signal and information for determining an intensity of the second beginning divided audio signal.

7. A method of decoding audio, the method comprising:

extracting an encoded mono audio signal and encoded side information from received audio data;

decoding the extracted mono audio signal and the extracted side information;

restoring first and second beginning restored audio signals from the decoded mono audio signal, and generating N-2 final restored audio signals from transient restored audio signals by decoding the first and second beginning restored audio signals, based on the decoded side information; and generating a first final audio signal and a second final audio signal by adjusting a phase of the first beginning restored audio signal, based on the decoded side information, wherein the side information comprises a phase difference between the first final audio signal and the second final audio signal.

8. The method of claim 7, wherein the generating the first final audio signal and the second final audio signal comprises generating a combination restored audio signal by adding the transient restored audio signals that are generated last from among the transient restored audio signals, and generating first and second final restored audio signals from the combination restored audio signal based on the decoded side information.

9. The method of claim 8, further comprising extracting information about differences between N decoded audio signals and N original audio signals in the received audio data, wherein the N decoded audio signals are generated by encoding and decoding the N original audio signals, wherein the first and second final restored audio signals are generated based on the decoded side information and the information about the differences.

10. The method of claim 8, wherein the decoded side information comprises:

information for determining intensities of the first and second beginning restored audio signals, the transient restored audio signals, and the first and second final restored audio signals; and information about phase differences between the first and second final restored audio signals restored from the first and second beginning restored audio signals, the transient restored audio signals, and the first and second final restored audio signals.

11. The method of claim 10, wherein the information for determining the intensities comprises information about an angle between a first vector and a third vector or between a second vector and the third vector in a vector space generated in such a way that the first vector and the second vector form a predetermined angle, wherein the first vector is about intensity of one of two following restored audio signals of each of the beginning restored audio signals, the transient restored audio signals, and the final restored audio signals, the second vector is about intensity of the other of the two following restored audio signals, and the third vector is generated by adding the first and second vectors.

12. The method of claim 11, wherein the restoring of the first and second beginning restored audio signals comprises:

determining an intensity of at least one of the first beginning restored audio signal and the second beginning restored audio signal, by using at least one of the angle between the first vector and the third vector and the angle between the second vector and the third vector;

calculating a phase of the first beginning restored audio signal and a phase of the second beginning restored audio signal based on information about a phase of the decoded mono audio signal and information about a phase difference between the first beginning restored audio signal and the second beginning restored audio signal; and restoring the first and second beginning restored audio signals based on the information about the phase of the decoded mono audio signal, the information about the phase of the second beginning restored audio signal, and the information for determining the intensities of the first and second beginning restored audio signals.

13. The method of claim 11, wherein, when a first final transient restored audio signal from among the final transient restored audio signals and the first final restored audio signal are restored from a J-1th transient restored audio signal, and the second final restored audio signal and a second final transient restored audio signal having an intensity that is the same as an intensity and a phase that is the same phase as the first final transient restored audio signal is restored from a Jth transient restored audio signal, and wherein the second final restored audio signal is restored by subtracting the first final transient restored audio signal from the Jth transient restored audio signal, when the first final transient restored audio signal is restored based on information about a phase of the J-1th transient restored audio signal, the information about a phase difference between the first final restored audio signal and the first final transient restored audio signal, and information for determining the intensity of the first final transient restored audio signal.

14. An apparatus for encoding audio, the apparatus comprising:

a mono audio generator that adjusts a phase of a first center input audio signal located in a center of received N input audio signals to be corresponding to a phase of a second center input audio signal located in the center of the received N input audio signals, and generates a mono audio signal by using the phase-adjusted first center input audio signal and the second center input audio signal;

a side information generator that generates side information for restoring the first center input audio signal and the second center input audio signal; and an encoder that encodes the mono audio signal and the side information, wherein the side information comprises a phase difference between the first center input audio signal and the second center input audio signal.

15. The apparatus of claim 14, wherein the mono audio generator further generates a first beginning divided audio signal and a second beginning divided audio signal from a beginning mono audio signal, the beginning mono audio signal generated from the phase-adjusted first center input audio signal and the second center input audio signal and generating a first final divided audio signal and a second final divided audio signal by using remaining input audio signals, among the N input audio signals other than the first and second center input audio signals, and each of the first and second beginning divided audio signals, and generating a final mono audio signal by adding the first and second final divided audio signals, and wherein the side information generator generates side information for restoring each of the N input audio signals, the first and second beginning divided audio signals, and the first and second final divided audio signals.

16. The apparatus of claim 15, wherein the mono audio generator comprises a plurality of down-mixers that each add two of audio signals among the N input audio signals, the first and second beginning divided audio signals, transient mono audio signals which are generated from the remaining input audio signals and the first and second beginning divided audio signals, and the first and second final divided audio signals.

17. The apparatus of claim 15, further comprising a difference information generator that encodes the N input audio, decodes the encoded N input audio signals, and generates information about differences between the N decoded input audio signals and the N received input audio signals, wherein the encoder encodes the information about the differences with the final mono audio signal and the side information.

18. The apparatus of claim 17, wherein the encoder generates a vector space in which a first vector and a second vector form a predetermined angle, wherein the first vector represents an intensity of the first center input audio signal, and the second vector represents an intensity of the second center input audio signal, generates a third vector by adding the first vector and the second vector in the vector space; and encodes at least one of information about an angle between the third vector and the first vector and information about an angle between the third vector and the second vector, in the vector space.

19. The apparatus of claim 15, wherein the encoder encodes information for determining intensities of the first and second center input audio signals, the remaining input audio signals, the first and second beginning divided audio signals, the transient divided audio signals, and the first and second final divided audio signals, and encodes information about phase differences between the first and second audio signals in the first and second center input audio signals, the remaining input audio signals, the first and second beginning divided audio signals, the transient divided audio signals, and the first and second final divided audio signals.

20. The apparatus of claim 17, wherein the encoder encodes at least one of information for determining an intensity of the first beginning divided audio signal and information for determining an intensity of the second beginning divided audio signal.

21. An apparatus for decoding audio, the apparatus comprising:

an extractor that extracts an encoded mono audio signal and encoded side information from received audio data;

a decoder that decodes the extracted mono audio signal and the extracted side information;

an audio restorer that restores first and second beginning restored audio signals from the decoded mono audio signal, generates N-2 final restored audio signals from transient restored audio signals by decoding the first and second beginning restored audio signals, based on the decoded side information and generates a first final audio signal and a second final audio signal by adjusting a phase of the first beginning restored audio signal, based on the decoded side information, wherein the side information comprises a phase difference between the first final audio signal and the second final audio signal.

22. The apparatus of claim 21, wherein audio restorer further generates a combination restored audio signal by adding the transient restored audio signals that are generated last from among the transient restored audio signals, and generating first and second final restored audio signals from the combination restored audio signal based on the decoded side information.

23. The apparatus of claim 22, wherein the audio restorer comprises a plurality of up-mixers that generate first and second restored audio signals from audio signals of each of the decoded mono audio signal, the beginning restored audio signals, and the transient restored audio signals, based on the side information.

24. The apparatus of claim 22, wherein the extractor extracts information about differences between N decoded audio signals and N original audio signals in the received audio data, wherein the N decoded audio signals are generated by encoding and decoding the N original audio signals, wherein the first and second final restored audio signals are generated based on the decoded side information and the information about the differences.

25. The apparatus of claim 22, wherein the decoded side information comprises:

information for determining intensities of the first and second beginning restored audio signals, the transient restored audio signals, and the first and second final restored audio signals; and information about phase differences between the first and second final restored audio signals restored from the first and second beginning restored audio signals, the transient restored audio signals, and the first and second final restored audio signals.

26. The apparatus of claim 25, wherein the information for determining the intensities comprises information about an angle between a first vector and a third vector or between a second vector and the third vector in a vector space generated in such a way that the first vector and the second vector form a predetermined angle, wherein the first vector is about intensity of one of two following restored audio signals of each of the beginning restored audio signals, the transient restored audio signals, and the final restored audio signals, the second vector is about intensity of the other of the two following restored audio signals, and the third vector is generated by adding the first and second vectors.

27. The apparatus of claim 26, wherein the audio restorer determines intensity of at least one of the first beginning restored audio signal and the second beginning restored audio signal, by using at least one of the angle between the first vector and the third vector and the angle between the second vector and the third vector, calculates a phase of the first beginning restored audio signal and a phase of the second beginning restored audio signal based on information about a phase of the decoded mono audio signal and information about a phase difference between the first beginning restored audio signal and the second beginning restored audio signal, and restores the first and second beginning restored audio signals based on the information about the phase of the decoded mono audio signal, the information about the phase of the second beginning restored audio signal, and the information for determining the intensities of the first and second beginning restored audio signals.

28. The apparatus of claim 26, wherein the audio restorer restores the first final restored audio signal and a first final transient restored audio signal from among the final transient restored audio signals from a J-1th transient restored audio signal among the transient restored audio signals, and restores the second final restored audio signal and a second final transient restored audio signal having an intensity that is the same as an intensity and a phase that is the same phase as the first final transient restored audio signal from a Jth transient restored audio signal, restores the first final transient restored audio signal based on the information about the phase of the J-1th transient restored audio signal, information about a phase difference between the first final restored audio signal and the first final transient restored audio signal, and information for determining the intensity of the first final transient restored audio signal, and restores the second final restored audio signal by subtracting the first final transient restored audio signal from the Jth transient restored audio signal.

29. A non-transitory computer readable recording medium having recorded thereon a program for executing the method of claim 1.

* * * * *